US010501288B2

(12) United States Patent
Yoshida

(10) Patent No.: US 10,501,288 B2
(45) Date of Patent: Dec. 10, 2019

(54) SEAL MEMBER FOR SEALING A DOOR SILL GAP

(71) Applicant: TOSHIBA ELEVATOR KABUSHIKI KAISHA, Kawasaki-shi, Kanagawa (JP)

(72) Inventor: Taku Yoshida, Saitama (JP)

(73) Assignee: TOSHIBA ELEVATOR KABUSHIKI KAISHA, Kawasaki-Shi (JP)

( * ) Notice: Subject to any disclaimer, the term of this patent is extended or adjusted under 35 U.S.C. 154(b) by 324 days.

(21) Appl. No.: 15/346,966

(22) Filed: Nov. 9, 2016

(65) Prior Publication Data

US 2017/0137263 A1 May 18, 2017

(30) Foreign Application Priority Data

Nov. 13, 2015 (JP) ..... 2015-223505

(51) Int. Cl.
*B66B 13/30* (2006.01)

(52) U.S. Cl.
CPC ..... *B66B 13/301* (2013.01); *B66B 13/308* (2013.01)

(58) Field of Classification Search
CPC ..... B66B 13/28; B66B 13/285; B66B 13/301; B66B 13/308; B66B 17/18
See application file for complete search history.

(56) References Cited

U.S. PATENT DOCUMENTS 1,152,012 A * 8/1915 Doren ..... B66B 13/301 14/71.1
2,739,354 A * 3/1956 Pope ..... B66B 17/18 187/334
3,396,822 A * 8/1968 Guilbert, Jr. ..... B66B 17/18 187/334
7,621,379 B2 11/2009 Miller et al.
9,932,171 B1 * 4/2018 Hall ..... B65G 1/00
9,994,426 B1 * 6/2018 Zhu ..... B66B 17/16
(Continued)

FOREIGN PATENT DOCUMENTS

CN 1839088 A 9/2006
JP S52/137840 A 11/1977
(Continued)

OTHER PUBLICATIONS

JP2009203068 English Translation.*
(Continued)

*Primary Examiner* — Minh Truong
(74) *Attorney, Agent, or Firm* — Foley & Lardner LLP

(57) ABSTRACT

A seal member for sealing a gap between a car-side door sill and a landing-side door sill is slidable between a sealing position and a retracted position and is driven by a link mechanism. The seal member is connected to an actuation spring that receives a movement force toward the sealing position. The link mechanism releases engagement with the actuating member in synchronization with a start of a door open operation of the car door to permit sliding toward the sealing position caused by the actuation spring. The link mechanism is engaged with the actuating member of the car door side in synchronization with movement of the car door toward a door close end to move the seal member to the retracted position resisting to the actuation spring.

13 Claims, 10 Drawing Sheets

(56) References Cited

U.S. PATENT DOCUMENTS

| | | | | |
|---|---|---|---|---|
| 2006/0243534 | A1 | 11/2006 | Miller et al. | |
| 2015/0096842 | A1* | 4/2015 | Cao | B66B 17/18 187/337 |

FOREIGN PATENT DOCUMENTS

| | | | |
|---|---|---|---|
| JP | H01/115679 | U | 8/1989 |
| JP | H08/048481 | A | 2/1996 |
| JP | H11-193192 | A | 7/1999 |
| JP | 2005-082268 | A | 3/2005 |
| JP | 2009/0203068 | A | 9/2009 |
| JP | 2009-286504 | A | 12/2009 |
| JP | 2014/0069960 | A | 4/2014 |

OTHER PUBLICATIONS

Japanese Office Action dated May 31, 2016 in counterpart Japanese Application No. 2015-223505 and partial English translation.

* cited by examiner

SEAL MEMBER FOR SEALING A DOOR SILL GAP

CROSS-REFERENCE TO RELATED APPLICATION

This application is based upon and claims the benefit of priority from the prior Japanese Patent Application No. 2015-223505 filed on Nov. 13, 2015, the entire contents of which are incorporated herein by reference.

TECHNICAL FIELD

Embodiments described herein relate generally to an elevator apparatus provided with a structure for sealing a gap generated between a landing-side door sill and a car-side door sill provided in a doorway to an elevator car.

BACKGROUND

In an elevator apparatus in which an elevator car is lifted or lowered between floors along a hoistway in a building to carry passengers or freight, there is a gap between the elevator car and an elevator lobby in each floor in order to facilitate lifting or lowering of the elevator car. For this reason, while the elevator car stops for landing in an elevator lobby, and an access door is opened, a gap is generated between a landing-side door sill and a car-side door sill. This door sill gap is dangerous because it may cause tumbling of a passenger or falling of a wheelchair or cart wheel. Furthermore, small personal items such as a key or a card may fall into a pit through the door sill gap, and it would be difficult to recover such a small item in some cases.

In this regard, a seal member for sealing a door sill gap has been proposed in the prior art to seal the door sill gap whenever the door is opened (for example, see JP 2009-286504 A).

In the technique of the prior art, a blocker (seal member) for sealing the door sill gap is provided on the bottom of the car platform in order to prevent a personal item from falling into a hoistway through the door sill gap by sealing the door sill gap whenever the elevator door is opened. Specifically, the blocker is housed in a blocker housing formed under the car-side door sill during a travel of the elevator car. However, the blocker is stretched using an actuator such as an electric motor to seal the door sill gap when the elevator car is landed, and the door is opened.

In this technique of the prior art, a relatively expensive actuator such as an electric motor is indispensable as described above. In addition, a sensor or a control circuit for operating the actuator at a predetermined timing is necessary. For this reason, the configuration becomes complicated, and this may generate a failure and increase cost.

In view of the aforementioned problems, it is therefore an object of the present invention to provide an elevator apparatus capable of sealing a gap between a landing-side door sill and a car-side door sill using a link mechanism mechanically operated in synchronization with a door open/close operation so as to obtain a mechanically driven reliable operation at low cost without using an expensive actuator.

DETAILED DESCRIPTION

An elevator apparatus according to an embodiment of the invention has a car-side door sill configured to guide a car door provided in a doorway of an elevator car along its open/close direction, a landing-side door sill configured to guide a landing door provided in an doorway to the elevator car in each floor where the elevator car can be landed along its open/close direction, a seal member shaped to seal a gap generated between the car-side door sill and the landing-side door sill and slidable between a sealing position in which the gap is sealed and a retracted position, and a link mechanism connected to the seal member to be engaged with an actuating member of the car door side in synchronization with an open/close operation of the car door in order to drive the seal member in a sliding direction by converting a force received from the actuating member by the engagement with the actuating member into the sliding direction of the seal member. The seal member is connected to an actuation spring that receives a movement force to the sealing position. The link mechanism is operated to release the engagement force with the car door-side actuating member in synchronization with a start of an opening operation from a door close end of the car door to permit sliding into the sealing position by the actuation spring and is engaged with the car door-side actuating member in synchronization with the movement to the door close end of the car door to receive the movement force of the car door and slide the seal member placed in the sealing position into the retracted position resisting to a spring force of the actuation spring.

In this configuration, a gap between the landing-side door sill and the car-side door sill is sealed using a link mechanism operated mechanically in synchronization with a door open/close operation. Therefore, it is possible to reliably obtain a mechanical driving operation without using an expensive actuator and provide an automatic seal member at low cost.

Embodiments will now be described specifically with reference to the accompanying drawings.

Figure 1:
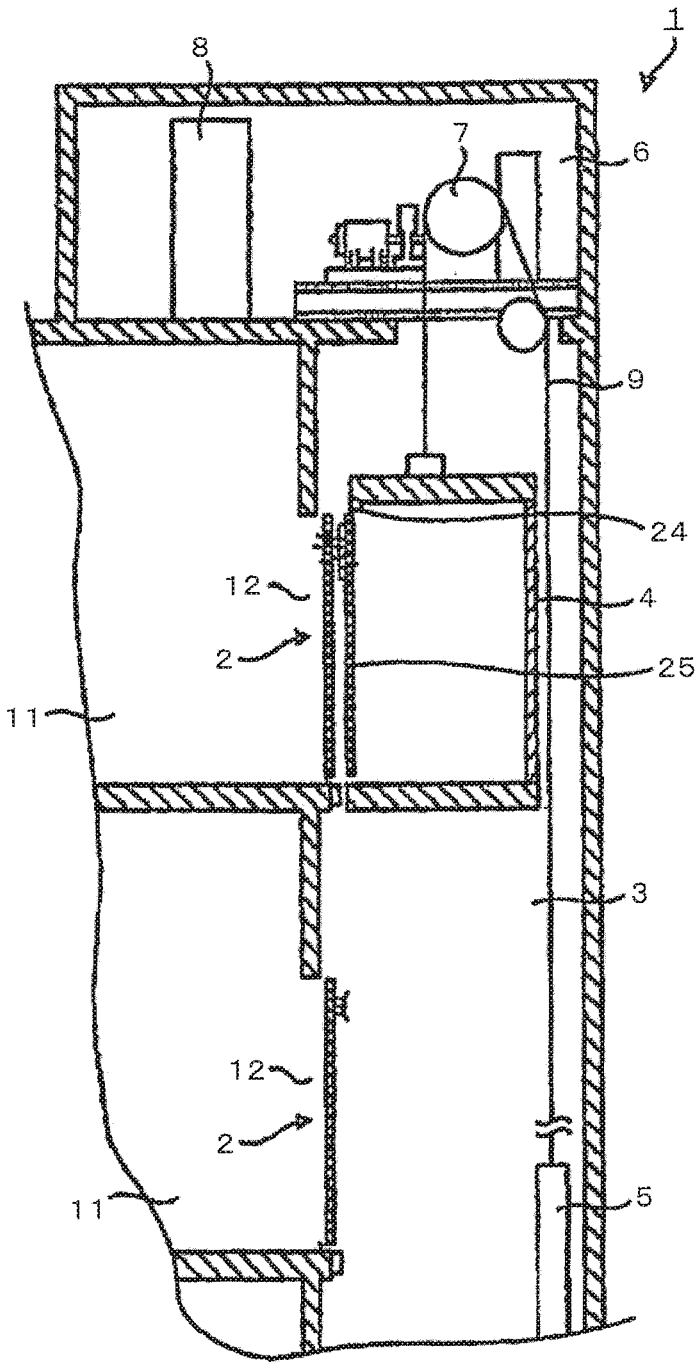
FIG. 1 is a diagram illustrating a whole configuration of an elevator apparatus according to an embodiment of the invention.

First, a whole configuration of the elevator apparatus will be described with reference to FIG. 1. As illustrated in FIG. 1, the elevator apparatus 1 has an elevator car 4 and a balance weight 5 placed inside a hoistway 3. On top of the hoistway 3, there is a machine room 6 provided with a hoist machine 7 for driving a main rope 9, a control system 8, and the like. The control system 8 controls the entire elevator apparatus 1 such that the hoist machine 7 is driven in response to a landing call or a car call to land the elevator car 4 in the calling floor.

Alternatively, a so-called machine-room-less (MRL) elevator apparatus may also be employed, in which the machine room 6 is removed, and the hoist machine 7 or the control system 8 is miniaturized and provided on top of the hoistway 3.

In this elevator apparatus 1, a doorway 12 for accessing the elevator car 4 inside the hoistway 3 is provided in each elevator lobby 11 of each floor in a building, and a landing door 2 is provided in the doorway 12. The landing door 2 is engaged with a car door 25 provided in a doorway 24 of the elevator car 4 by using an interlock mechanism at the time of landing of the elevator car 4 and is opened or closed in synchronization with opening or closing of the car door 25.

Figure 2:
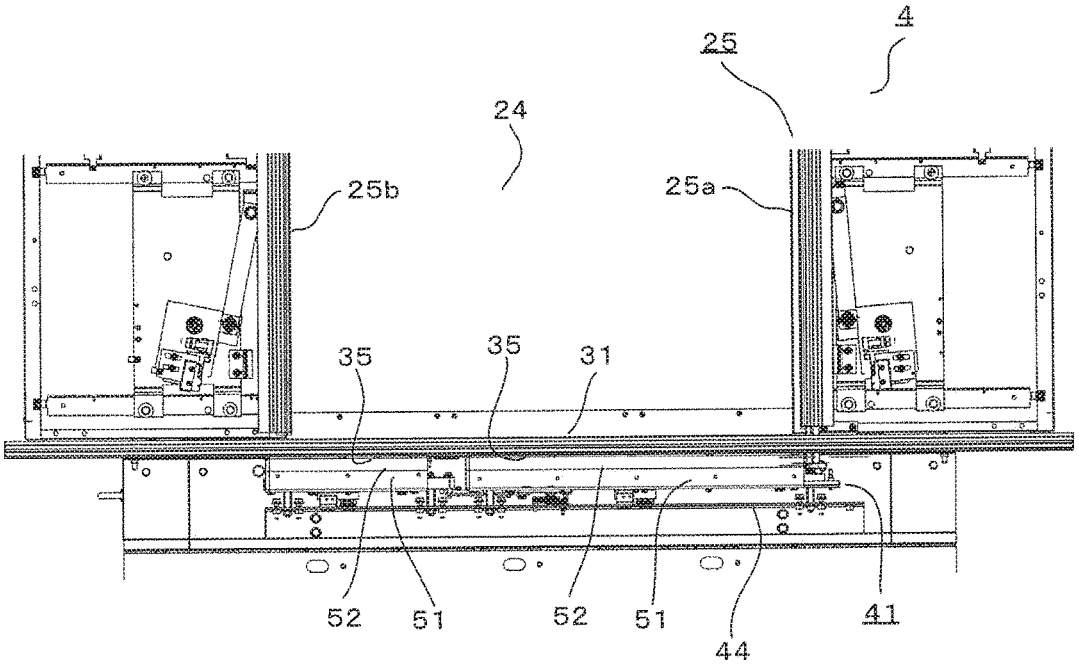
FIG. 2 is a front view illustrating a door part of an elevator car according to an embodiment of the invention as seen from a landing side.

FIG. 2 is a front view illustrating the car door 25 provided in the doorway of the elevator car 4 as seen from the elevator lobby 11 side. The car door 25 is a so-called center opening type in which a pair of door panels 25*a* and 25*b* are moved to the opposite left and right directions in the drawing for a door-open operation (in FIG. 2, only doorstop portions are shown, and other parts are omitted). The pair of door panels 25*a* and 25*b* are connected to a door open/close mechanism provided in both sides of the doorway 24 of the elevator car 4. The door panels 25*a* and 25*b* are driven to the left and right directions in the drawing using the door open/close mechanism for the door open/close operation.

Note that any door open/close mechanism known in the art may be employed as long as it can drive a pair of door panels 25*a* and 25*b* in synchronization using power of a motor (not shown) in the left-right direction along a guide rail for door open/close operation. Since the door open/close mechanism does not directly relate to the present invention, its description will not be given herein.

A car-side door sill 31 is provided in the doorway of the elevator car 4, so that a pair of door panels 25*a* and 25*b* of the car door 25 are guided to slide along its open/close direction. The car-side door sill 31 is provided in a lower side portion of the doorway 24 of the elevator car. A guide trench formed on its upper surface is engaged with lower end portions of the pair of door panels 25*a* and 25*b* to guide them along the open/close direction.

Figure 6:
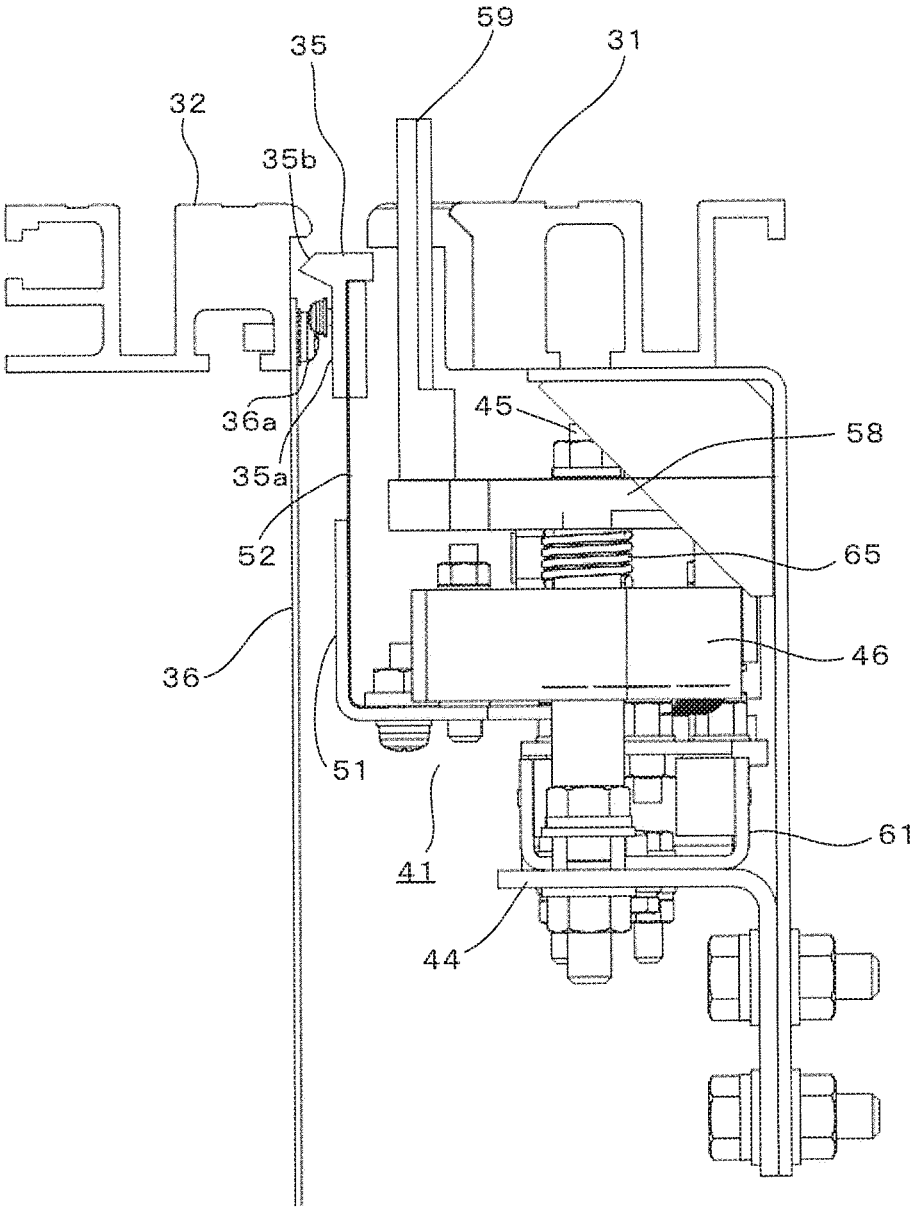
FIG. 6 is a side view illustrating a relationship between car-side and landing-side door sills and the seal member placed in a sealing position.
Figure 7:
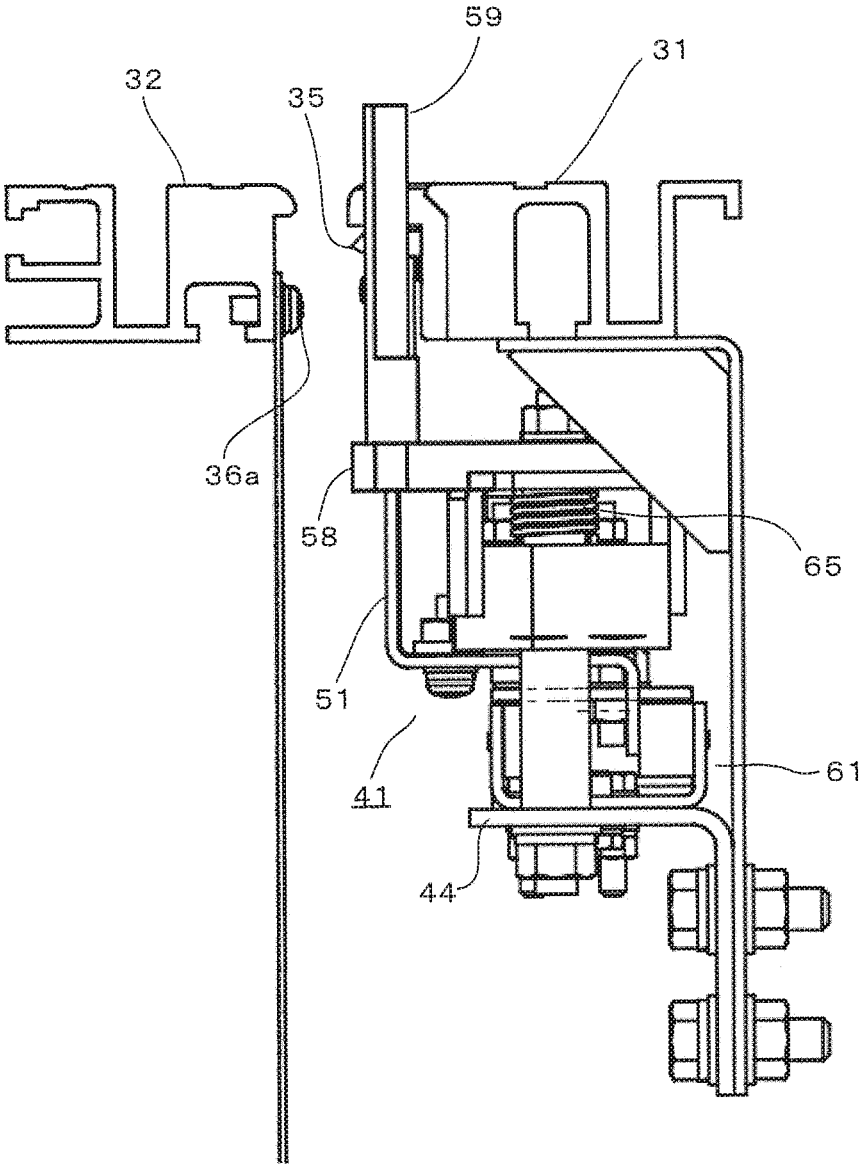
FIG. 7 is a side view illustrating a relationship between the car-side and landing-side door sills and the seal member placed in a retracted position.
Figure 8:
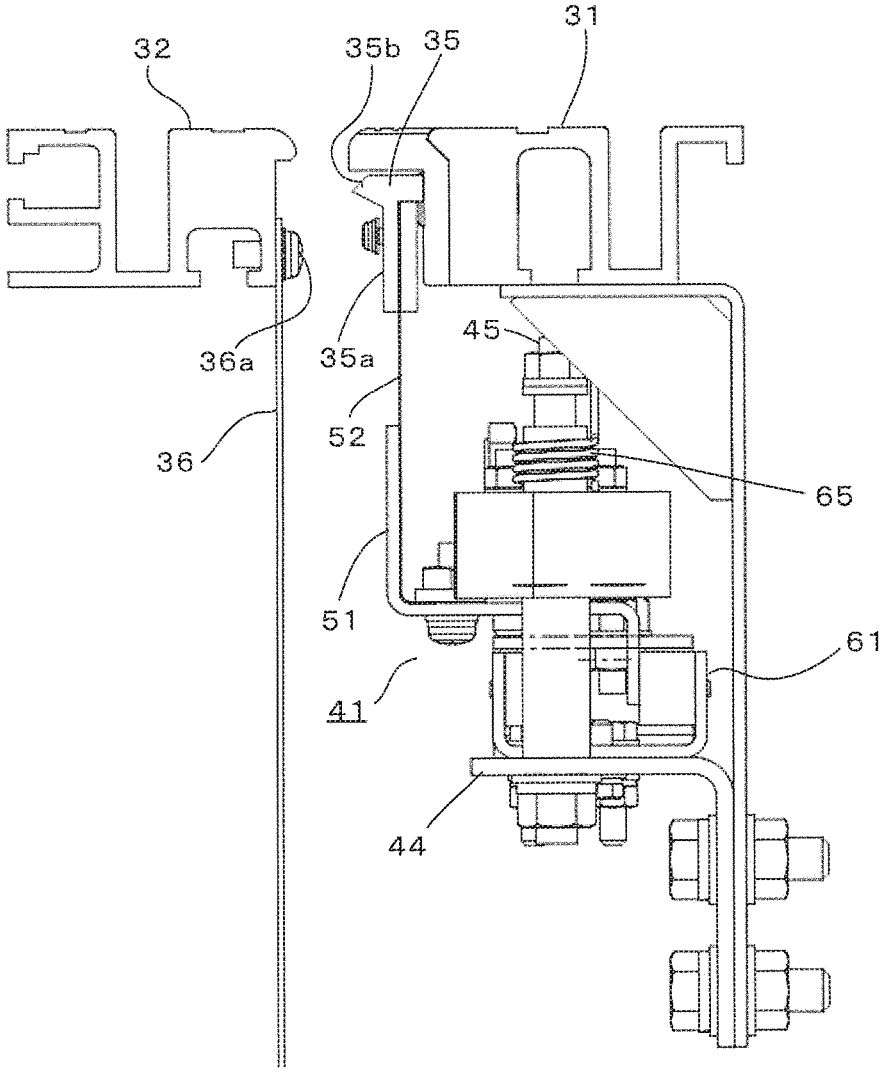
FIG. 8 is a side view illustrating a state of the seal member in which a part of components are removed from FIG. 7 for easy understanding.

Along with the car-side door sill 31, a door sill 32 is also provided in the elevator lobby 11 side as illustrated in FIGS. 6 to 8. This lading-side door sill 32 is placed to face a side surface (the left side surface in FIGS. 6 to 8) of the car-side door sill 31 with a predetermined clearance. A guide trench is also formed on the upper surface of the landing-side door sill 32, so that the landing door 2 of FIG. 1 is guided to slide along its open/close direction.

Although not shown in the drawings, this landing door 2 is also a center opening type having a pair of door panels engaged with the car door 25 to be opened or closed along with the car door 25 when the elevator car 4 is landed on the elevator lobby 11 as described above. That is, the pair of door panels are closed and locked by an interlock mechanism (not shown) while the elevator car 4 is not landed. When the elevator car 4 is landed, the door panels of landing door 2 are engaged with an engagement member (not shown) of the elevator car 4 side, so that the locking state is released, and the landing door 2 is opened or closed in synchronization with the car door 25.

When the elevator car 4 is landed on a predetermined floor, a gap illustrated in FIGS. 6 to 8 is generated between the car-side door sill 31 and the landing-side door sill 32 as described above. According to an embodiment of the invention, a seal member 35 is provided to seal this gap.

This seal member 35 is divided into the left and right portions as illustrated in FIG. 2. Through this dividing portion, the car-side door sill 31 passes by the interlock mechanism (not shown) provided in the landing side when the elevator car 4 is lifted or lowered. In order to allow the interlock mechanism to pass therethrough, the seal member 35 is divided while its clearance is maintained between the left and right.

Note that this clearance of the dividing portion is nearly fully sealed by a convex portion (not shown) provided in the landing-side door sill 32 to match each other and inserted when the elevator car 4 is landed.

The upper surface of the seal member 35 is placed under the upper surfaces of the car-side door sill 31 and the landing-side door sill 32 as illustrated in FIGS. 6 to 8. The seal member 35 has a shape and a dimension capable of sealing the gap between the door sills 31 and 32 as illustrated in FIG. 6. That is, the seal member 35 has a length slightly longer than the width of the car-side doorway 24 of FIG. 2 and a width slightly larger than the gap between the door sills 31 and 32 of FIGS. 6 to 8.

The seal member 35 has a vertically long cross section and is provided with a concave portion 35*a* formed to face the right side surface of the landing-side door sill 32. The concave portion 35*a* is provided to avoid a head portion of a screw 36*a* on the right side surface of the landing-side door sill 32. The screw 36*a* is used to install an apron 36 for partitioning an underfloor space. In addition, a chamfer 35*b* is provided on the upper corner of the seal member 35.

The seal member 35 may be formed of metal or resin. Preferably, the resin is employed in consideration of manufacturability, a cushioning capability with other components, and the like.

The seal member 35 is configured to slide between a sealing position in which a gap between the door sills 31 and 32 illustrated in FIG. 6 is sealed and a retracted position in which the seal member 35 is retracted to the lower side of the car-side door sill 31 illustrated in FIGS. 7 and 8 (in FIG. 8, some components are omitted intentionally from FIG. 7 in order to facilitate understanding a state of the seal member 35 in the retracted position). In addition, the link mechanism 41 described below drives the seal member 35 to slide between the sealing position and the retracted position described above in synchronization with the open/close operation of the car door 25.

Figure 3:
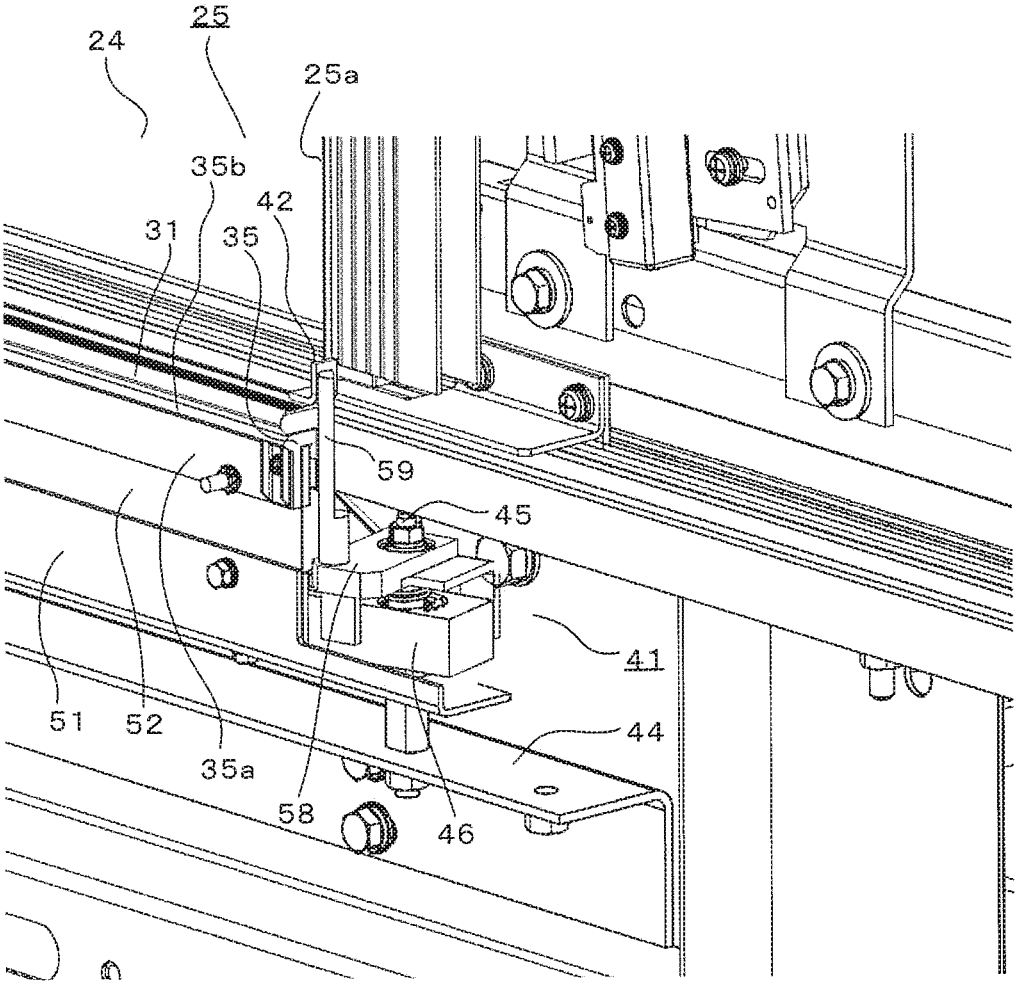
FIG. 3 is a perspective view illustrating a relationship between a link mechanism and a car door-side actuating member according to an embodiment of the invention.

The seal member 35 is installed in a bracket 51 provided in the link mechanism 41 by interposing a leaf spring 52. As illustrated in FIG. 3, the link mechanism 41 can be engaged with an actuating member 42 of the car door 25 side in synchronization with the open/close operation of the car door 25. In addition, by virtue of this engagement with the actuating member 42, a force received from the actuating member 42 is converted into a sliding direction of the seal member 35 to drive the seal member 35 in the sliding direction.

Figure 4:
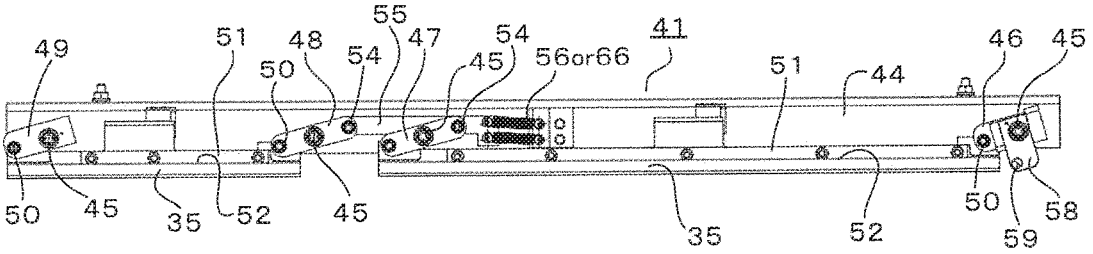
FIG. 4 is a plan view illustrating a relationship between a link mechanism and a seal member placed in a retracted position.
Figure 5:
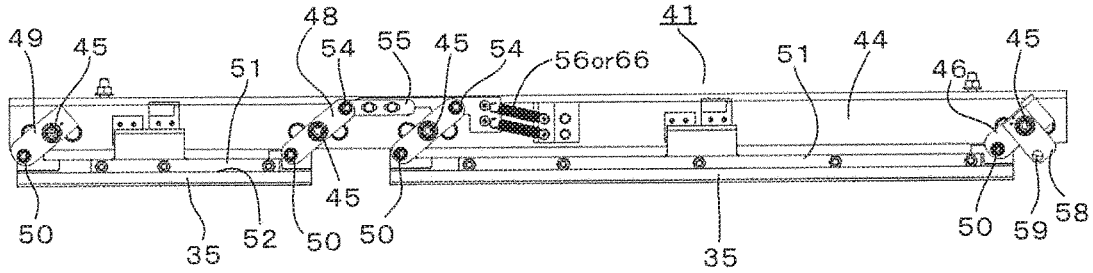
FIG. 5 is a plan view illustrating a relationship between a link mechanism and the seal member placed in a sealing position.

According to this embodiment of the invention, the link mechanism 41 has four links 46, 47, 48, and 49 and brackets 51 pivotally connected to each end of the links 46, 47, 48, and 49 using connecting shafts 50 as illustrated in FIGS. 4 and 5. The four links 46, 47, 48, and 49 are pivotally supported by pivot shafts 45 on the support member 44 provided in the elevator car 4 side.

Out of the four links, the inner links 47 and 48 are used to drive a link operation, and the other ends of the inner links 47 and 48 are connected to a connecting rod 55 using the connecting shafts 54. A tension spring 56 is stretched between the right end of the connecting rod 55 and the support member 44, so that a force for translating the bracket 51 toward the support member 44 is exerted to the link mechanism 41.

A base end of a lever 58 is integrated into the pivot shaft 45 of the link 46 of the link mechanism 41. An actuating pin 59 is erected on a tip of the lever 58. An upper side surface of the actuating pin 59 can be engaged with the actuating member 42 integrated into the door panel 25*a* of the car door 25 as illustrated in FIG. 3. That is, the actuating pin 59 abuts on and is engaged with the actuating member 42 when the car door 25 is opened to a predetermined door-open position. As a result, the lever 58 and the pivot shaft 45 integrated with the lever 58 are pivoted counterclockwise in the drawing.

By virtue of this pivoting, the link 46 integrated with the pivot shaft 45 and the other links 47, 48, and 49 connected through the brackets 51 are also pivoted counterclockwise in the drawing resisting to a tensile force of the tension spring 56. Through such an operation of the link mechanism 41, the seal member 35 supported by the brackets 51 and the leaf springs placed thereover is fed from the retracted position illustrated in FIGS. 4, 7, and 8 to the sealing position illustrated in FIGS. 5 and 6.

Here, the tension spring 56 described above is finally connected to the seal member 35 through the link mechanism 41, the brackets 51, and the like. This tension spring 56 exerts a force for returning the seal member 35 to the retracted position illustrated in FIGS. 4, 7, and 8 through the link mechanism 41. Therefore, the tension spring 56 serves as a return spring for returning the seal member 35 to the retracted position (hereinafter, referred to as a return spring 56).

In this manner, when the car door 25 is opened to a predetermined door-open position, the link mechanism 41 engages the actuating pin 59 with the actuating member 42 of the car door 25 side as illustrated in FIG. 3, and receives a movement force for the car door 25 in the door-open direction to slide the seal member 35 placed in the retracted position into the sealing position resisting to the spring force of the return spring 56.

Figure 9:
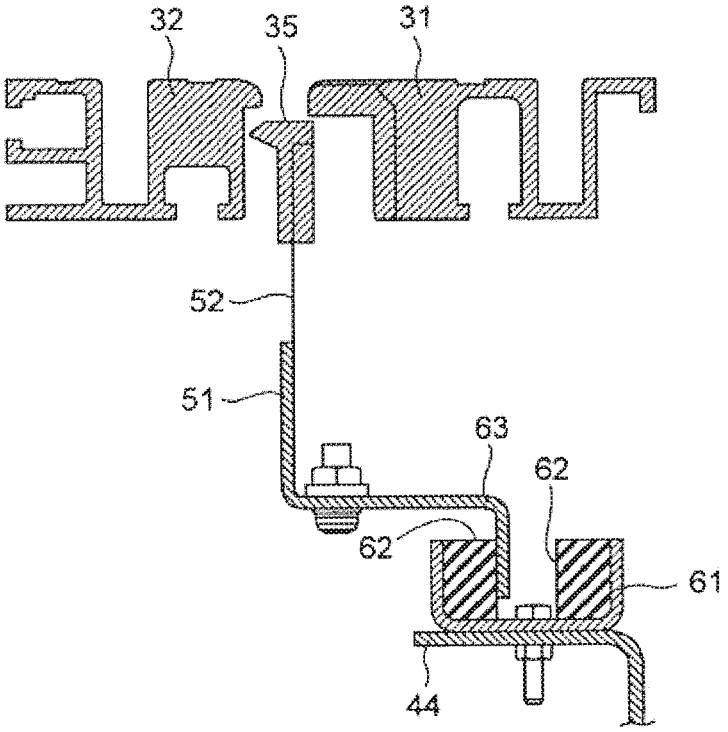
FIG. 9 is a diagram specifically illustrating a stopper portion.

In regard to sliding of the seal member 35 described above, a stopper 61 for stopping the seal member 35 in the sealing position or the retracted position is provided on the support member 44 as illustrated in FIGS. 6 to 8. FIG. 9 specifically shows this stopper 61. The stopper 61 has a U-shaped member fixed to the support member 44 and cushioning elements 62 such as rubber provided on its both inner surfaces. In addition, an L-shaped cross-sectional abutting member 63 extending from the bracket 51 of the seal member 35 side is inserted between the cushioning elements 62.

In this configuration, the abutting member 63 extending from the bracket 51 abuts on the both inner side surfaces of the U-shaped member of the stopper 61. Therefore, it is possible to properly stop the sliding of the seal member 35 in the sealing position and the retracted position. Note that the cushioning element 62 such as rubber may be provided in any one or both of the stopper 61 and the abutting member 63.

Out of the pivot shafts 45 included in the link mechanism 41, the pivot shaft 45 integrated with the lever 58 placed in the right end in FIGS. 2 and 3 serves as a rotation shaft rotating when the actuating pin 59 erected on the lever 58 abuts on and is engaged with the actuating member 42 of the car door 25 side. As illustrated in FIGS. 6 to 8, the rotation shaft is provided with a torsion spring 65 to exert a rotational force resisting to rotation generated by the engagement with the actuating member 42.

In this configuration, while the actuating pin 59 is not engaged with the actuating member 42, it is possible to return the actuating pin 59 to a proper position at all times.

In the configuration described above, while the car door 25 is closed, the actuating member 42 of the car door 25 side illustrated in FIG. 3 does not abut on and is not engaged with the actuating pin 59 of the link mechanism 41 side, and the link mechanism 41 does not receive a force exerted from the car door 25 side. For this reason, the seal member 35 and the bracket 51 that supports the seal member 35 are returned to the support member 44 side by virtue of the tensile force of the return spring 56 illustrated in FIG. 4. Therefore, the seal member 35 is placed in the retracted position under the car-side door sill 31 as illustrated in FIGS. 7 and 8.

When the elevator car 4 is landed on an elevator lobby, and the car door 25 is opened to a predetermined door-open position, the actuating member 42 provided in the door panel 25*a* side abuts on and is engaged with the actuating pin 59 of the link mechanism 41. By virtue of the door-open force of the door panel 25*a*, the lever 58 provided with the actuating pin 59 is pivoted counterclockwise in the drawing with respect to the pivot shaft 45.

Through this operation, the link mechanism 41 is pivoted toward the same direction resisting to the tensile force of the return spring 56, and the bracket 51 and the seal member 35 supported by the bracket 51 are fed from the state of FIG. 4 to the state of FIG. 5. Therefore, the seal member 35 slides from the retracted position under the car-side door sill 31 of FIGS. 7 and 8 to the left in the drawing and reaches the sealing position of FIG. 6.

In this sealing position, the seal member 35 seals a gap between the door sills 31 and 32. Therefore, it is possible to prevent any small personal item from falling into a pit through this gap and easily recover it. In addition, since the upper surface of the seal member 35 is placed under the upper surfaces of the door sills 31 and 32, a load of an object placed on the door sills 31 and 32 does not affect the seal member 35. Therefore, it is possible to prevent a load from generating a damage to the support portion of the seal member 35.

If the load of the elevator car 4 is remarkably changed while the gap is sealed by the seal member 35, the elevator car 4 may slightly rise temporarily. Even when the elevator car 4 rises temporarily in this way, there is no damage or problem because the upper corner of the seal member 35 has a chamfer 35*b*, and the seal member 35 is supported by the leaf spring 52.

For example, the elevator car 4 slightly rises temporarily when the elevator car 4 is filled with passengers, and they exit from the elevator car 4 at once. In this case, the seal member 35 placed in the seal position illustrated in FIG. 6 also rises and may abut on a lateral side portion of the landing-side door sill 32. However, due to the chamfer 35*b* formed on the upper corner of the seal member 35 facing the lateral side portion of the landing-side door sill 32, the abutting force of this portion can be weakened. Therefore, it is possible to prevent a damage caused by the abutting. Furthermore, since the seal member 35 is supported by the leaf spring 52, the leaf spring 52 is also flexed vertically when the abutting occurs. Therefore, it is possible to weaken an impact caused by the abutting by virtue of the cushioning effect. This also prevents a damage caused by the abutting.

Meanwhile, when the car door 25 is closed and moves to a predetermined door-close position, the actuating member 42 placed in the door panel 25*a* side recedes from the actuating pin 59 of the link mechanism 41. For this reason, the force applied to the link mechanism 41 through the actuating pin 59 is released, and the pivot shaft 45 of the link mechanism 41 is pivoted clockwise in the drawing by virtue of the tensile force of the return spring 56, so that the bracket 51 and the seal member 35 supported by the bracket 51 are returned from the state of FIG. 5 to the state of FIG. 4. Therefore, the seal member 35 slides from the sealing position of FIG. 6 to the right side in the drawing to reach the retracted position under the car-side door sill 31 of FIGS. 7 and 8.

In this manner, the seal member 35 slides from the retracted position to the sealing position using the link mechanism actuated by receiving the movement force to the car door open direction. In addition, when the car door is closed, the seal member 35 slides from the sealing position to the retracted position by virtue of the spring force of the return spring. In this sliding movement, the seal member 35 can properly stop in both the sealing position and the retracted position using the stopper 61. For this reason, it is possible to reliably prevent the seal member from overrunning and being damaged by colliding with other components without stopping at a proper position. Even in the event of overrunning, the impact caused by colliding with other components can be absorbed by the flexing of the leaf spring 52 because the seal member 35 is supported by the leaf spring 52. Therefore, it is possible to prevent components from being damaged.

When the leaf spring 52 is flexed, a gap may be generated in a joint portion with the bracket 51. If dust is inserted into this gap, it may be difficult to restore its original shape. In this regard, a guide such as a caulking or a packing may be additionally applied to a portion where such a gap is likely generated in advance.

Figure 10:
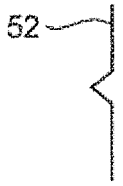
FIG. 10 is a diagram illustrating an exemplary bending portion of a leaf spring.
Figure 11:
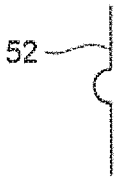
FIG. 11 is a diagram illustrating another exemplary bending portion of the leaf spring.

The leaf spring 52 can be flexed vertically as described above. For this reason, in order to more effectively generating vertical flexing, at least a horizontal bending portion may be formed in a vertical center of the leaf spring 52 to generate a vertical spring force. As the bending portion, the leaf spring 52 may be bent to have a V-shaped cross section as illustrated in FIG. 10 or may be curved in a semicircle shape as illustrated in FIG. 11. Alternatively, the leaf spring 52 may be curved in an S-shape by vertically forming a plurality of successive V-shaped bending portions or curving a plurality of successive semicircles.

As a result, it is possible to effectively flex the leaf spring 52 in a vertical direction in parallel with to a surface of the leaf spring 52.

In the aforementioned embodiment, the link mechanism 41 is configured to return the bracket 51 toward the support member 44 by virtue of the tensile force of the return spring (tension spring) 56 at all times as illustrated in FIGS. 4 and 5. Alternatively, instead of the return spring 56, an actuation spring 66 capable of generating a reaction force between the support member 44 and the right end of the link 47 may be provided to exert a force for feeding the bracket 51 toward the direction of FIG. 5 at all times. That is, the seal member 35 supported by the bracket 51 and the leaf spring 52 provided on the bracket 51 is connected to the actuation spring 66 through the link mechanism 41 to receive a movement force toward the sealing position of FIGS. 5 and 6 at all times.

Figure 12:
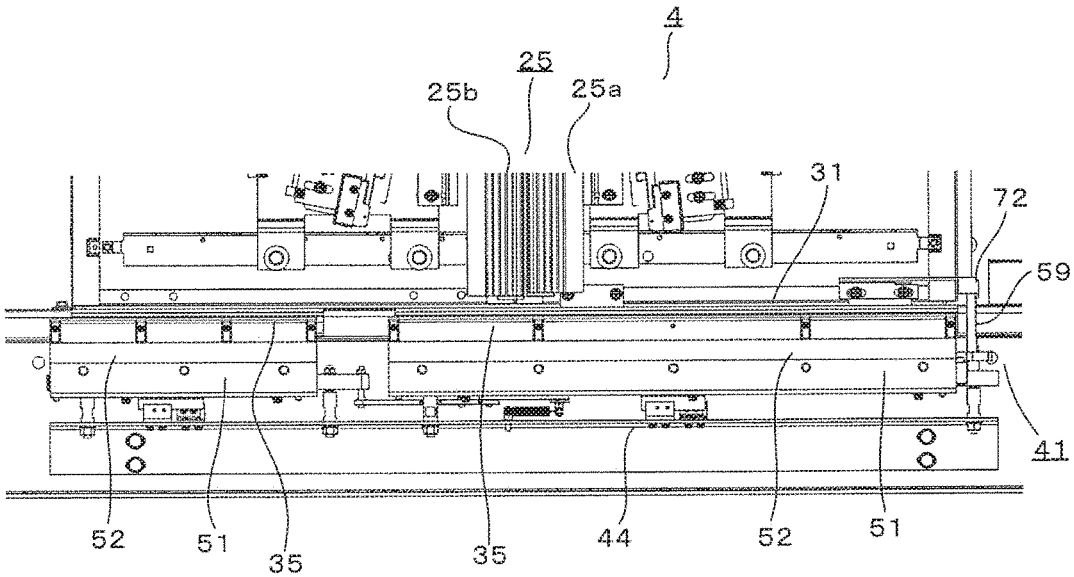
FIG. 12 is a front view illustrating a door part of an elevator car according to another embodiment of the invention as seen from a landing side.
Figure 13:
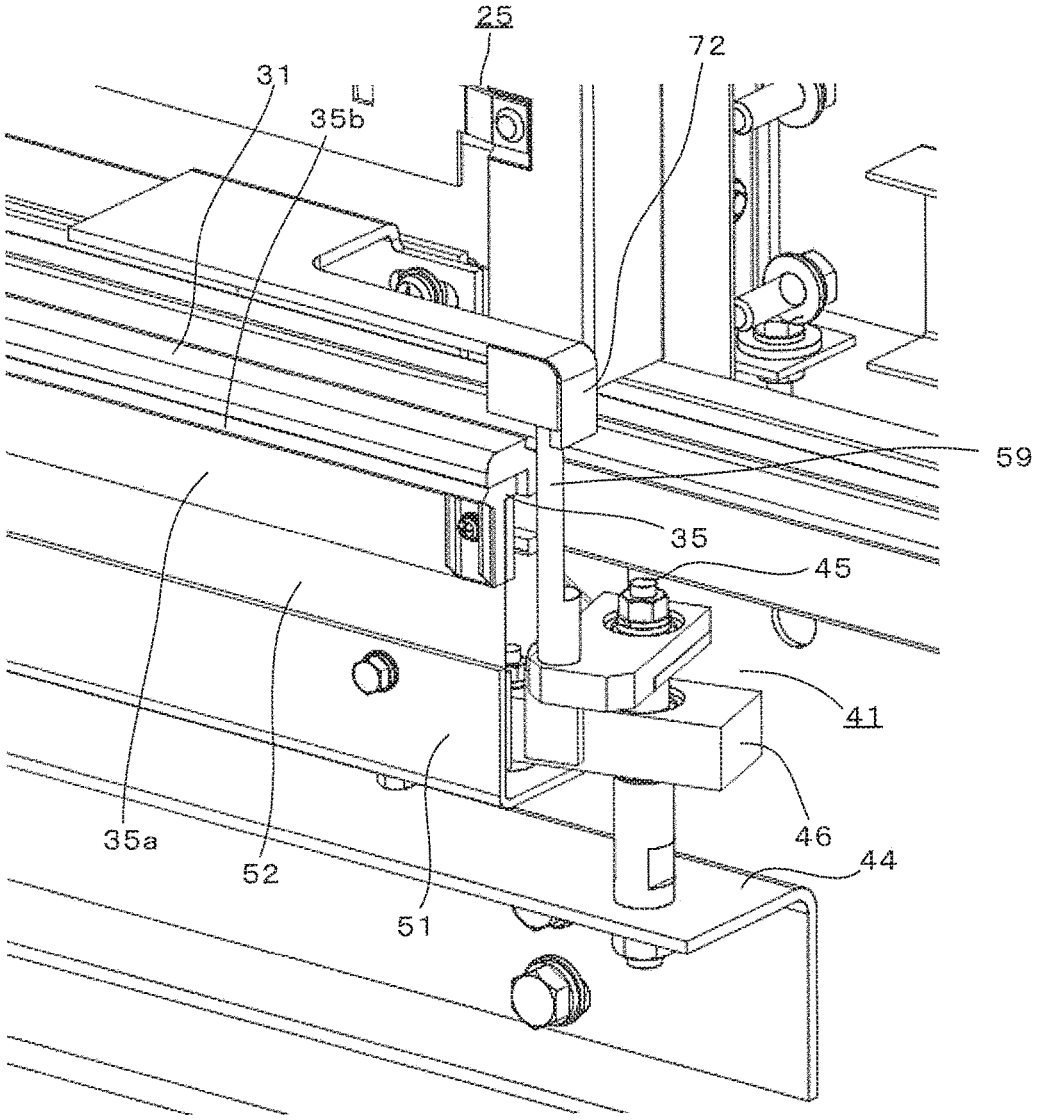
FIG. 13 is a perspective view illustrating a relationship between a link mechanism and a car door-side actuating member according to another embodiment of the invention.

In this case, when the car door 25 is perfectly closed and is placed in a door close end position illustrated in FIG. 12, the actuating pin of the link mechanism 41 is engaged with the actuating member 72 provided in the door panel 25*a* side as illustrated in FIG. 13. For this reason, the link mechanism 41 is held in the state of FIG. 4 in which the reaction force of the actuation spring 66 is accumulated. That is, the seal member 35 is held in the retracted position of FIGS. 7 and 8.

In contrast, when the car door 25 is opened, and the door panel 25*a* starts to perform the door-open operation from the door close end of FIG. 12, the actuating member 72 in the car door 25 side moves from the state of FIG. 13 to the right in the drawing. Therefore, the engagement force with the actuating member 72 is released. For this reason, each link 46, 47, 48, and 49 of the link mechanism 41 is pivoted counterclockwise in the drawing with respect to the pivot shaft 45 by virtue of the reaction force of the actuation spring 66. Through this operation of the link mechanism 41, the seal member 35 supported by the bracket 51 and the leaf spring 52 on the bracket 51 is fed from the state of FIG. 4 to the state of FIG. 5. That is, the seal member 35 slides from the retracted position of FIGS. 7 and 8 to the sealing position of FIG. 6.

Meanwhile, when the car door 25 is closed from the full open state, the door panel 25*a* is closed to the vicinity of the door close end, so that the actuating member 72 is engaged with the actuating pin 59 of the link mechanism 41 side as illustrated in FIG. 13. For this reason, the lever 46 integrated with the actuating pin 59 is driven clockwise in the drawing by virtue of the closing force of the door panel 25*a*. That is, the link mechanism 41 returns the seal member 35 supported by the bracket 51 and the leaf spring 52 on the bracket 51 from the state of FIG. 5 to the state of FIG. 4 by virtue of the force exerted to close the door panel 25*a*. That is, the seal member 35 slides from the sealing position of FIG. 6 to the retracted position of FIGS. 7 and 8.

In this manner, the link mechanism 41 is operated to release the engagement with the actuating member 72 as the car door 25 starts the door open operation from the door close end. Therefore, the link mechanism 41 permits sliding of the seal member 35 toward the sealing position by virtue of the reaction force of the actuation spring 66. In addition, the link mechanism 41 is engaged with the actuating member 72 of the car door 25 side in synchronization with the movement of the car door 25 toward the door close end and receives the movement force of the car door 25 so that the seal member 35 placed in the sealing position slides to the retracted position.

That is, if the car door 25 starts to be opened, the seal member 35 moves to the sealing position immediately. If the car door 25 is closed, the seal member 35 moves from the sealing position to the retracted position immediately before the car door 25 is fully closed. For this reason, even when a passenger or freight accesses the car in the middle of the door open or close operation, the seal member 35 seals the gap between the door sills 31 and 32. Therefore, it is possible to reliably prevent a small personal item from falling through the gap.

Note that a portion of the link mechanism 41 engaged with the actuating members 42 and 72 of the car door 25 side, that is, a position where the actuating pin 59 is provided is placed in the outside of the width of the doorway 24 of the elevator car 4 opened or closed by the car door 25.

Although the preferred embodiments of the present invention have been described above, the embodiments are merely illustrative and do not limit the scope of the present invention. These embodiments can be practiced in other various forms, and various omissions, substitutions and changes may be made without departing from the scope of the invention. The embodiments and modifications thereof are included in the scope or spirit of the present invention and in the appended claims and their equivalents.

What is claimed is:

1. An elevator apparatus comprising:

a car-side door sill configured to guide a car door provided in a doorway of an elevator car along its open/close direction;

a landing-side door sill configured to guide a landing door provided in a doorway to the elevator car in each floor where the elevator car can be landed along its open/close direction;

a seal member shaped to seal a gap between the car-side door sill and the landing-side door sill and slidable between a sealing position in which the gap is sealed and a retracted position; and a link mechanism connected to the seal member, engaged with an actuating member of a car door side in synchronization with a car door open/close operation, and configured to convert a force received from the actuating member by the engagement with the actuating member into a sliding direction of the seal member to drive the seal member in the sliding direction, wherein the seal member is connected to an actuation spring configured to receive a movement force toward the sealing position, wherein the link mechanism is structured to release the engagement force with the actuating member of the car door side in synchronization with a start of the door open operation from a door close end of the car door to permit sliding toward the sealing position by the actuation spring, and wherein the link mechanism is structured to engage with the actuating member of the car door side in synchronization with the movement of the car door toward the door close end and receive a movement force of the car door to slide the seal member placed in the sealing position to the retracted position in resistance to a spring force of the actuation spring, wherein the seal member is connected to a bracket provided in a link mechanism side through an elastic material and is displaceable toward the gap between the car-side door sill and the landing-side door sill.

2. The elevator apparatus according to claim 1, wherein the link mechanism has a plurality of links including a dual-end connecting type link;

each of the plurality of links is pivotally supported by a rotation shaft;

one end of the dual-end connecting type link is connected to the seal member through the bracket; and another end of the dual-end connecting type link is connected to the actuation spring, which receives the movement force toward the sealing position to the seal member through a connecting rod.

3. The elevator apparatus according to claim 1, wherein a portion of the link mechanism engaged with the actuating member of the car door side is placed outside a width of the doorway of the elevator car opened or closed by the car door.

4. The elevator apparatus according to claim 1, wherein an upper surface of the seal member is placed under upper surfaces of the car-side door sill and the landing-side door sill.

5. The elevator apparatus according to claim 1, wherein the elastic material is a leaf spring, and at least a horizontal bending portion is formed in a vertical center of the leaf spring to generate a vertical spring force.

6. The elevator apparatus according to claim 1, wherein the elastic material is a leaf spring, and at least a horizontal bending portion is formed in a vertical center of the leaf spring, and the bending portion has a V-shaped or semicircular cross section.

7. The elevator apparatus according to claim 1, wherein the seal member is divided in a portion where the car-side door sill passes by an interlock mechanism provided in a landing side when the elevator car is lifted or lowered.

8. The elevator apparatus according to claim 1, further comprising a stopper for stopping sliding of the seal member in the sealing position and the retracted position by abutting on an abutting member provided in the seal member side.

9. The elevator apparatus according to claim 1, further comprising a stopper for stopping sliding of the seal member in the sealing position and the retracted position by abutting on an abutting member provided in the seal member side; and a cushion provided in any one of the stopper and the abutting member.

10. The elevator apparatus according to claim 1, wherein the seal member is formed of resin.

11. The elevator apparatus according to claim 1, wherein an upper corner of the seal member is chamfered.

12. The elevator apparatus according to claim 1, wherein a portion of the seal member facing a lateral side of the landing-side door sill is provided with a concave portion for avoiding a head of a screw used to install an apron for partitioning an underfloor space provided in the lateral side.

13. The elevator apparatus according to claim 1, wherein the link mechanism has a rotation shaft rotated by engagement with the actuating member of the car door side, and the rotation shaft is provided with a torsion spring for exerting a rotational force resisting to a direction of the rotation caused by the engagement with the actuating member.

* * * * *